United States Patent [19]

Allen et al.

[11] Patent Number: 4,674,390

[45] Date of Patent: Jun. 23, 1987

[54] KETTLEDRUM

[76] Inventors: Barbara A. Allen; Rebecca Kite, both of P.O. Box 1954, Bloomington, Ind. 47402

[21] Appl. No.: 667,217

[22] Filed: Nov. 1, 1984

Related U.S. Application Data

[63] Continuation-in-part of Ser. No. 617,747, Jun. 6, 1984, Pat. No. 4,635,524.

[51] Int. Cl.[4] ..... G10D 13/04

[52] U.S. Cl. ..... 84/419; 84/411 A; 84/421

[58] Field of Search ..... 84/411 A, 411 R, 415, 84/413, 419–422 R

[56] References Cited

U.S. PATENT DOCUMENTS

| | | | |
|---|---|---|---|
| Re. 16,226 | 12/1925 | Strupe . | |
| 355,970 | 1/1887 | Boulanger . | |
| 355,971 | 1/1887 | Boulanger . | |
| 874,050 | 12/1907 | Bower . | |
| 1,356,193 | 10/1920 | Danly . | |
| 1,391,437 | 9/1921 | Wiedoeft . | |
| 1,469,197 | 9/1923 | Strupe . | |
| 1,561,789 | 11/1925 | Ludwig et al. . | |
| 1,561,790 | 11/1925 | Ludwig et al. . | |
| 1,565,329 | 12/1925 | Robison . | |
| 1,755,569 | 4/1930 | Strupe | 84/419 |
| 1,845,625 | 2/1932 | Robison . | |
| 1,916,123 | 6/1933 | Greenleaf . | |
| 2,070,082 | 2/1937 | Horak | 84/419 |
| 2,074,194 | 3/1937 | Strupe | 84/419 |
| 2,150,981 | 3/1939 | Ludwig | 84/419 |
| 2,205,593 | 6/1940 | Jeffries | 84/419 |
| 2,259,268 | 10/1941 | Robison . | |
| 2,261,119 | 11/1941 | Ludwig et al. | 84/421 |
| 2,276,846 | 3/1942 | Jeffries | 84/419 |
| 2,502,733 | 4/1950 | Ludwig | 84/418 |
| 2,568,504 | 9/1951 | Ludwig | 84/419 |
| 2,586,476 | 2/1952 | Murbach | 84/419 |
| 2,587,310 | 2/1952 | Goodman | 84/419 |
| 2,729,133 | 1/1956 | Ludwig | 84/419 |
| 3,021,743 | 2/1962 | Ludwig | 84/419 |
| 3,163,075 | 12/1964 | Toperzer, Jr. | 84/419 |
| 3,279,299 | 10/1966 | Murbach | 84/419 |
| 3,376,777 | 4/1968 | Becker-Ehmck | 84/419 |
| 3,608,418 | 9/1971 | Chaffee et al. | 84/419 |
| 3,646,843 | 3/1972 | Kregal | 84/419 |
| 3,701,834 | 10/1972 | Rubio | 84/419 |
| 3,747,463 | 7/1973 | Hinger | 84/419 |
| 4,056,998 | 11/1977 | Rampton | 84/419 |
| 4,188,852 | 2/1980 | Light | 84/411 A |
| 4,278,003 | 7/1981 | Hanson | 84/419 X |

FOREIGN PATENT DOCUMENTS

| | | |
|---|---|---|
| 87629 | of 1922 | Australia . |
| 12816 | 4/1881 | Fed. Rep. of Germany . |
| 15199 | 10/1881 | Fed. Rep. of Germany . |
| 82118 | 7/1895 | Fed. Rep. of Germany . |
| 407916 | 1/1925 | Fed. Rep. of Germany . |
| 607449 | 12/1934 | Fed. Rep. of Germany . |
| 1024321 | 2/1958 | Fed. Rep. of Germany . |
| 923594 | 2/1947 | France . |
| 458236 | 7/1950 | Italy . |
| 2310 | of 1856 | United Kingdom . |
| 590803 | 7/1947 | United Kingdom . |

*Primary Examiner*—Benjamin R. Fuller
*Attorney, Agent, or Firm*—Barnes & Thornburg

[57] ABSTRACT

A percussion instrument includes a drum body and a percussion head movable with respect to and stretched over the drum body. A master tensioning member is provided for pulling the drumhead downward to enable a musician to vary the pitch of the sound produced when the drumhead is struck. The master tensioning member is operatively coupled to the drumhead, and is adaptable for use with drumheads of varying size. A lever system is provided for moving the master tensioning member vertically downwardly. A foot pedal is provided for enabling the user to actuate the lever system. The pedal includes an engaging tooth, and is swivelable to engage and disengage the tooth with complementary teeth to lock the pedal selectively in position. The pedal tooth thereby permits the user to adjust and fix the tension on the drumhead. The pedal is connected to the lever system by a movable fulcrum, which permits the user to exert a smooth, even force when depressing the pedal and actuating the lever system.

6 Claims, 13 Drawing Figures

FIG. 1
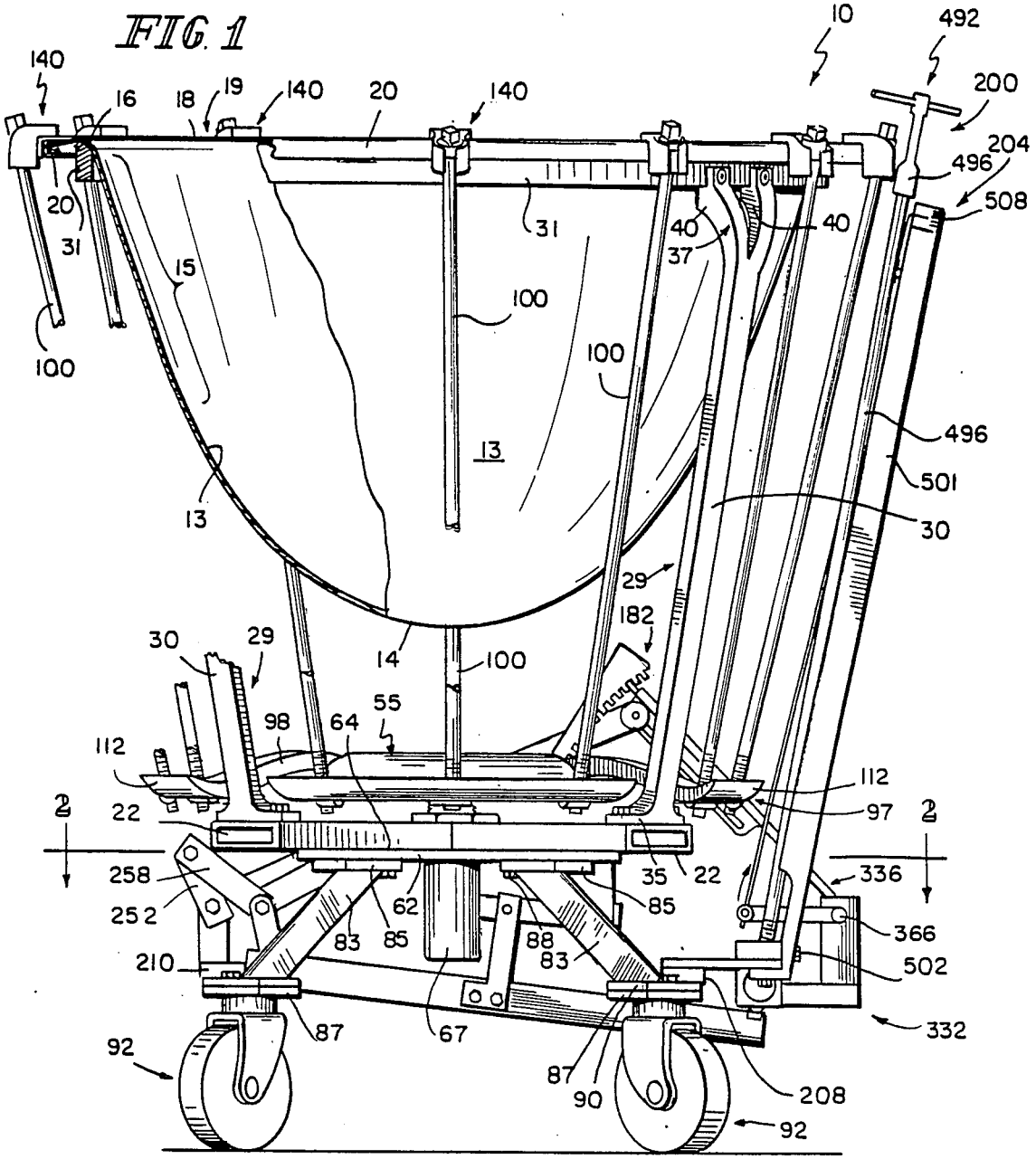
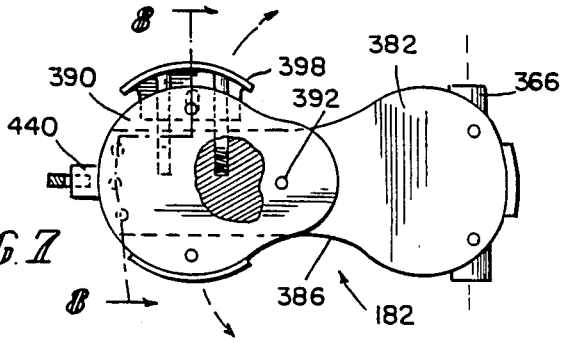
FIG. 7
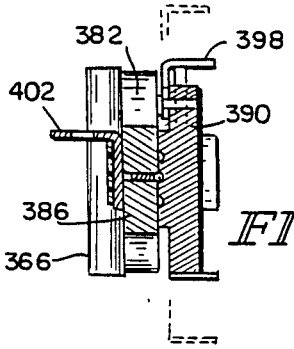
FIG. 8

KETTLEDRUM

This is a continuation-in-part of patent application Ser. No. 617,747 filed June 6, 1984 now U.S. Pat. No. 4,635,524.

This invention relates to musical instruments and more particularly to percussion instruments such as drums.

The acoustical properties of the round vibrating membrane which the player strikes in a musical drum to produce a sound are complex. In drums such as the base drum, tenor drum, or snare drum, the indefinite pitch of the sound produced when the drum has been struck has usually been a desirable characteristic of the insrument. However, in the kettledrum or timpano, a strong sense of pitch has been required by musical compositions calling for a definite pitch from these drums. Unlike, for example, the string family which can be characterized by having an easily obtainable definite pitch, the goal of producing a drum with a definite pitch has been largely unachievable due to the properties of the acoustics of the vibrating membrane which characterizes the drum family.

Membranophones, the genus of timpani and all drums, are analogous to members of the string family in several ways. With both a string and a membrane, tension is the restoring force that makes the system vibrate after pressure is applied to the vibrating member (i.e., plucking or bowing in a string; striking a blow to the drumhead). With a string, the tension is applied linearly. With a circular membrane, such as is found in timpani, the tension is applied about the circumference of the membrane. In both, the greater the tension of the vibrating member, the higher the fundamental pitch or frequency of the sound produced. Both membranophones and strings are tuned by an alteration of the tension of the vibrating member.

However, major differences between the vibrations of an ideal string and an ideal circular membrane result in significant differences in the perceived and measured pitch definition and clarity of each instrument. The frequencies of a string's overtones are harmonics. Harmonics are integral multiples of the fundamental frequency. With the ideal membrane, these mode frequencies are inharmonic. Moreover, the nodes of a vibrating string (the positions along its length that remain stationary while the rest of the string is in motion) are one-dimensional. The nodes of the vibrating circular membrane however are two-dimensional. Therefore, whereas a vibrating string has nodal points, a vibrating membrane has nodal lines and nodal curves. The curves may be curved line segments and closed generally planar nodal curves. Hereinafter all of these are generally referred to as nodal lines for simplicity.

The number and complexity of these nodal lines reflect directly the complexity of the overall motion of the vibrating circular membrane. Increases in the number of nodes and the node frequency go hand in hand with increasingly complex vibratory motions. The increased complexity of resulting sound reflects the increased complexity of the nodes of vibration of the drum head.

A number of factors determines the fundamental node frequency of the circular membrane. These factors include the amount of tension applied to the membrane, the diameter of the membrane, and the characteristics of the material from which the membrane is made, since different materials have different densities. The tension of the membrane is proportionally related to the frequency, while the diameter and the density of the membrane are inversely proportional to the fundamental frequency produced. The frequency $f_1$ of the lowest mode of an ideal membrane is given by $$f_1 = \frac{0.766}{D} \frac{\sqrt{T}}{\sqrt{d}}$$

where T is the tension stretching the head in newtons per meter width, d is the density of the head in kilograms per square meter, (usually assumed to be constant throughout the membrane), and D is the diameter of the head in meters. Thus, the means for producing a desired fundamental frequency in a drum will be related to the tensioning apparatus, delimiters of the drumhead diameter, and the density of the material comprising the drumhead. However, the means for producing a definite and clear pitch which comprises the fundamental frequency and its related overtones or partials involves more than these variables of applied tension, membrane diameter, and membrane density.

Over a century ago, Helmholtz recognized that a musical tone conveying a clear sense of pitch must be made up of several strong harmonic overtones to have a rich, musical sound. This tone must have not only a fundamental frequency, but also overtones with the frequencies of these overtones related to the fundamental frequency in whole-number ratios. For any musical instrument, the overtones audible in addition to the fundamental pitch of the musical note being played are essential characteristics of the sound of the given instrument. Because of the complex acoustics of a round vibrating membrane, the characteristic sound of a timpano is well known to be a complex mixture of the fundamental pitch and various theoretically predictable, audible partial overtones. Moreover, Rayleigh, Taylor, Rossing, Benade, Hall, Backus, Tubis and others have shown that these partials are inharmonic with regard to the fundamental pitch being expressed. Although the addition of the kettle, which acts as a baffle for the vibrating circular membrane, has been shown in practice to alter the frequencies of these partials to make the overtones closer in some cases to the ratio of whole numbers necessary for a harmonic overtone series, no kettle has before been designed which approaches the definitiveness of pitch desired by timpani players.

For the timpani player, this inharmonic overtone series characteristic of timpani has resulted in compromises between trying to produce a definite pitch on an instrument which science has predicted cannot be tuned to a definite pitch.

One object of the present invention is to produce a tympanic instrument which more nearly achieves the goal of obtaining a definite pitch.

In accordance with the instant invention, a percussion instrument is provided which comprises a body member and a percussion head carried by the body member. Tensioning rods are provided along with means for operatively coupling the tensioning rods to the percussion head. A master tensioning member is provided for tensioning the percussion head. The master tensioning member has a central portion and leg portions extending radially outwardly from the central portion. Adjacent leg portions define an opening therebetween. Means are provided for coupling the tensioning rods to the master tensioning member.

Also in accordance with the instant invention, a percussion instrument is provided which provides a body member, a percussion head carried by the body member, a tensioning member operatively coupled to the percussion head for exerting tension on the percussion head, and a piston operatively coupled to the tensioning member for moving the tensioning member to alter the tension on the head. Means are provided for moving the piston means. The piston moving means includes a movable first lever for moving the piston and a second movable lever operatively coupled to the first lever for moving the first lever. A shaft is provided which is rotatably supported by the frame. A first crank arm is fixed to the shaft for rotation therewith. A second crank arm is provided along with means for operatively coupling the second crank arm to the first crank arm and second lever. The first and second crank arms are cooperable for translating rotation of the shaft into generally linear movement of the second lever. Means are also provided for rotating the shaft.

The instant invention improves over prior art drums through the application of theoretical acoustics to alter the audible frequencies of the partials of a vibrating circular membrane so that these frequencies approach a harmonic series more nearly than possible with the prior art. This improvement has been possible in part through the design of a resonating, amplifying, and baffling member or drum body. Such design has been effected through the formulation of a relationship between the drum body volume, diameter, depth, and shape not previously conceived or executed in terms of kettle or drum body manufacturing. Additionally, the effects of damping, viscothermal and mechanical losses in the kettle itself have been factored into this formulation for use in kettle design in a manner not previously conceived in kettle design and manufacturing. This improvement in the design of the drum body is enhanced by improvements in certain other mechanical features of the timpano for the purpose of improving the pitch definition possible for a timpano of any diameter, tensioned to produce any desired fundamental frequency within its range. The means to these improvements and others will be disclosed in the following description of our invention.

In addition to the physical properties of drums which lack pitch clarity, several other problems have beset the manufacturers and users of prior art timpani. Among the several problems with known tympanic instruments are: the lack of tone clarity; the difficulty of "clearing" the timpano head; the rapid decay of a sound produced on a timpano; the impossibility of obtaining even tension at each percussion head tensioning point over the entire range of possible tensions; the restricted dynamic range of the drum if tone and pitch definition are to be maintained; the difficulty of adapting the timpani with ease to being played in various configurations or "set-ups" desired by the player; the variable resistance in the pedal movement requiring varying amounts of work by the player to obtain various pitches; the inability of individual players to choose preferred ankle-leg action combinations in operating the pedal; the inability of individual players to choose preferred distance between the pedal and the playing surface; the insecurity of the pedal locking mechanism and difficulty in unlocking a locked mechanism quickly for tuning changes; the complexity and difficulty of manufacturing the lever mechanism so that the fine tuning mechanism can be easily reached by the player; the inconvenience of the provisions of prior instruments for changing the relative position of the playing area of the timpano head; and the inconvenience and inconsistency of prior provisions for indicating the tuning positions of the timpano pedal.

It is also an object of the instant invention to provide an instrument which alleviates or eliminates the foregoing difficulties.

The present invention addresses these problems through fundamental changes in: the acoustical chamber of the timpano; the contact area between the vibrating membrane and the acoustical chamber; the support means of the acoustical chamber; the tensioning members of the timpano; the tensioning member system and the supporting means for the timpano; the tensioning member system and the central tensioning unit of the lever-pedal system of the timpano; the lever system of the timpano; the pedal system of the timpano; and the conjunction of the lever-pedal system of the timpano.

These and other features and advantages of the present invention will become apparent to those skilled in the art upon a consideration of the following detailed description of a preferred embodiment exemplifying the best mode of carrying out the invention as presently perceived. The detailed description particularly refers to the accompanying figures in which:

FIG. 1 is a partly broken away side elevational view of a kettledrum constructed according to the present invention, taken from the left side relative to the musician's position when playing the drum;

FIG. 7 is a partly fragmenatray top plan view of a pedal constructed according to the present invention;

FIG. 8 is a sectional view of the pedal of FIG. 7, taken generally along section lines 8—8 of FIG. 7;

Figure 2:
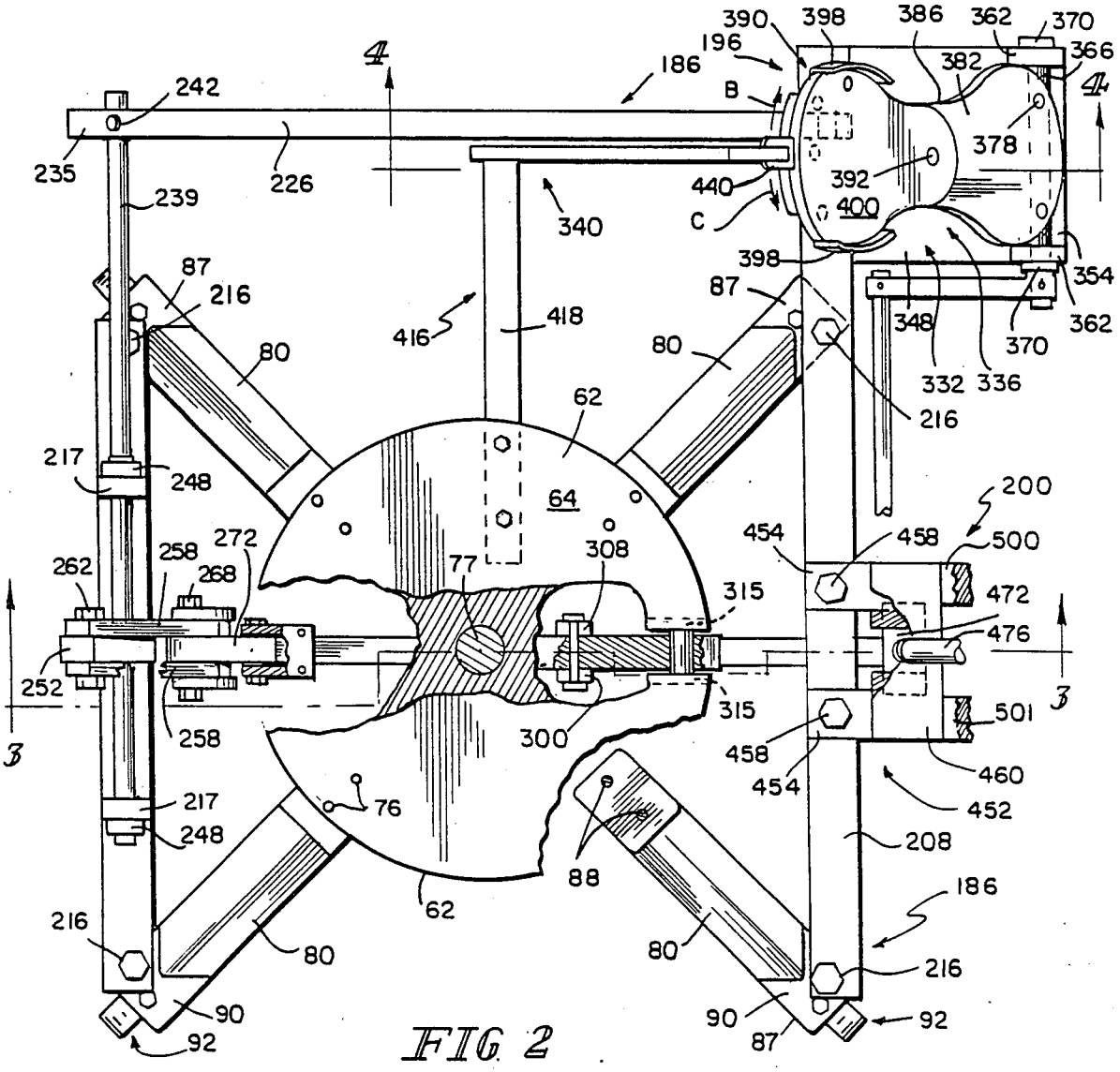
FIG. 2 is a partly broken away sectional view, taken generally along section lines 2—2 of FIG. 1.

The instant invention is shown in the Figures embodied in a kettledrum 10. However, particular aspects of the invention are adaptable to other musical instruments, for example, to other types of drums.

With particular reference to FIG. 1, the kettledrum 10 includes a kettle bowl 13 constructed from copper sheet hammered over a form. This kettle bowl 13 can be described by an equation which relates the bowl depth, the diameter at the top of the kettle lip 16, the bowl volume, and the shape of the bowl. The kettle bowl 13 shown in FIG. 1 has a generally parabolic shape. Alternatively, the kettle bowl 13 can have a spherical basin portion 14 and a generally linear side portion 15 or can have a generally part-spherical shape, or can have other configurations chosen to meet the sound criteria of the user. The variously sized bowls 13 of a set of several timpani are shaped according to the expected and desired pitch range of each drum so that the partials which the manufacturer or user wishes to emphasize in each drum 10 and the overlap in the fundamental pitches and partials among the drums 10 in a set of timpani are such that a matched set of drums 10 may be obtained. Such a set of drums is matched in terms of fundamental pitch, clarity, resonance, emphasis of desired partials, timbre, and dynamic range. Each drum bowl 13 thus is an acoustic resonator whose dimensions, volume, and shape are determined within specified limits of mechanical tolerance by the manufacturer to suit the aforementioned purposes of musicality.

For a bowl or a kettle which is generally a paraboloid of revolution, the equations defining the bowl are as follows: $y=cx^2$, $c=D/R^2$ and $V=\pi R^2D/2$, where V is the volume of the bowl or kettle, D is the depth at the center of the bowl and R is the radius of the bowl at its lip. Where the bowl is a quartic paraboloid of revolution, $y=bx^2+cx^4$, where $b=(4-1/S)D/2R^2$, $c=(1/S-2)D/2R^4$, and $V=\pi DR^2(\frac{1}{3}+1/12S)$, where the other variables are as described above and S is a "shape" variable determined by the configuration of the bowl. Generally, S will vary between $\frac{1}{4}$ and $\frac{1}{2}$. Larger values of S indicate that the bottom of the bowl is relatively more pointed or conical, while smaller values of S indicate that the bottom of the bowl is flatter.

When $S=\frac{1}{2}$, $C=0$. This is the case for a quadratic paraboloid of revolution, since under the circumstances in which $c=0$, b reduces to $\pi D/R^2$ and V reduces to $DR^2/2$.

Depending on the specific characteristics desired by the manufacturer or user, such characteristics as timbre and tone may be further regulated by varying the materials used to make the bowl 13. Characteristics of tone and timbre may be correlated to the damping and other characteristics of such material as: electrolytic tough pitch copper; oxygen free copper; deoxidized copper; annealed copper; work-hardened hammered copper; spun copper; copper alloys; and various aluminum alloys, according to an equation which enables a manufacturer to make specialized acoustical chamber bowl 13 for numerous different musical needs. For some conditions and musical needs, the acoustical chamber bowl 13 may be manufactured from fiberglass-reinforced plastic.

Other considerations involved in the selection of the bowl shape are based upon the fundamental frequency relationship for an ideal membrane, discussed previously. Since tympanists typically choose drums based upon drum diameter to produce a particular fundamental, the kettle radius R is ordinarily the first value chosen. Subsequently, the bowl depth at the center, D in the formulae presented immediately above, must be determined. In determining this value, it is of assistance to consider the average wavelength of the expected pitches to be produced by a drum, and divide by 4 to get the quarter wavelength of te expected pitch for the drum. This will be the desired depth D of the bowl.

Experiments have indicated that for drums with larger radii R, the percentage of audible higher partials decreases as volume V increases. If p, the number of audible higher partials, or higher partials perceived by the listener, is considered an indication of the "brightness" of timbre of the drum, then for drums having larger radii R, volume V is inversely proportional to p. However, the opposite appears to be true for drums having smaller radii R. For these drums, volume V is generally proportional to p. The limit toward which both of these relationships tend appears to be 26.5 inches (67.3 cm.) or so. Therefore, in the determination of volume V for various drum radii R, the tastes of the user must be considered. If a "brighter" sound is desired, the relationships between V and p suggest what V will be acceptable for a give R. Although it is difficult to define quantitatively the relationship between V and p, a qualitative understanding of the interrelationship between V, R and p is of considerable assistance in defining drum dimensions. If a tympanist can reasonably decribe p, this qualitative relationship permits fashioning of a drum which provides the desired characteristics.

With D, R and V determined, S, the shape constant, can be determined according to the formulae presented above.

Other experimental results have helped to determine other drum parameters, such as bowl material and the method of bowl manufacture. Again, many of these parameters are largely matters of the tympanist's tastes and the tympanist's ability to articulate these tastes. However, the relationships which follow are of some assistance in quantifying drum performance.

Among the determining characteristics in drum resonance are k, the velocity of sound waves in various materials (typically in m/sec). Resonance is believes to be inversely proportional to k. If j is the coefficient of damping in various materials from which the bowl can be fashioned, resonance is believed inversely proportional to j. Other factors affect timbre and tone quality of the drum. If i is defined as the percentage or number of inharmonic partials perceived or audible, p again is the "brightness" of the sound, the percentage or number of higher partials perceived or audible, n is the diameter of the vent hole in the bottom of the bowl, q is an "average" loudness or intensity level desired from the drum, w is a dynamic range ($\Delta q$, the difference between the loudest and softest audible sounds desired from the drum), m is the roundness of the bowl lip, and z is the flatness of the bowl lip, experiments tend to indicate that n is inversely proportional to p, q is inversely proportional to j, q is inversely proportional to k, w is inversely proportional to j, w is inversely proportional to k, m is inversely proportional to i, z is inversely proportional to i, and, for $\frac{1}{4}\leqq S\leqq\frac{1}{2}$, S is proportional to p.

The acoustical chamber bowl 13 further includes an angular, outwardly bent, downwardly opening lip or flange 16. Kettle lip 16 is turned radially outwardly and radiused to form a contact bridge 17 (FIG. 5) for supporting the vibrating portion 18 of drumhead 19. The bridge 17 has a relatively narrow width, preferably 0.031 inches (0.79 mm) or less. The bridge 17 should have a substantially uniform width throughout the circumference of the angular kettle lip 16, and is preferably formed to conform to its chosen size within a tolerance of ±0.003 inch (0.0762 mm). The contact bridge 17, and hence kettle lip 16 should also be as nearly circular as possible. Additionally, the contact bridge 17 should be made to be self-lubricating. This can be accomplished through the use of a strip 12 of self-adhering fluorocarbon resin applied to the bridge 17. The use of a strip 12 of fluorocarbon obviates the problems caused by other lubricants such as graphite or cork grease, which often tend to flake, dampen or mute the sound of the drumhead.

The percussion head 19 closes the top opening of bowl 13. The head 19 includes the generally circular vibratory portion 18 which is surrounded and captured by a rigid annular membrane gripping ring 20. The drumhead 19 is supported on the kettle bowl 13 by the bridge 17. The head 19 can be variably tensioned as will be described infra. The membrane 18 may be made of skin, plastic, or other suitable material and is customarily made of mylar or calf skin. Preferred embodiments include calf hide with a so-called "German tuck," or mylar wrapped about a flesh hoop with a "German tuck" or an "American tuck," with a "tone ring" insert as described in U.S. Pat. No. 2,934,989 to Belli.

Figure 5:
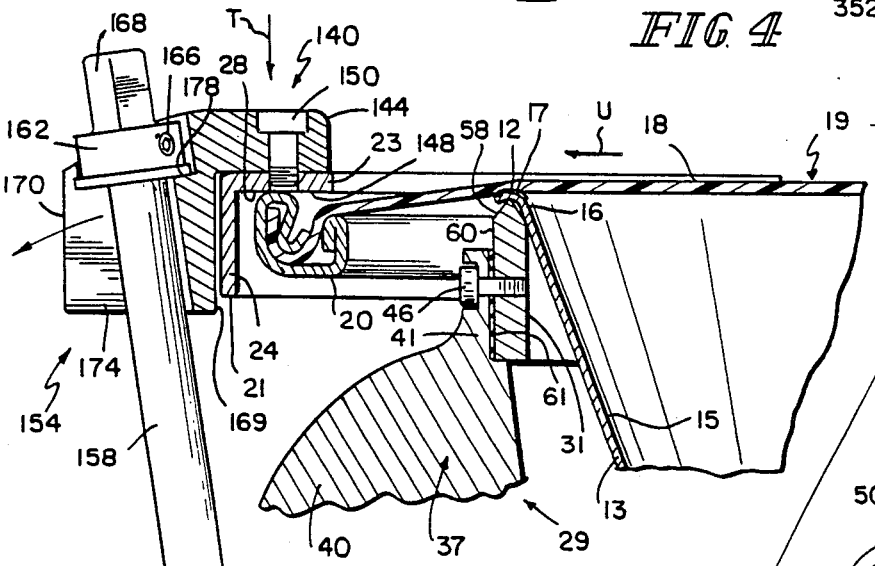
FIG. 5 is an enlarged partly broken away view showing the membrane, kettle lip, counterhoop and tensioning attachments.

The membrane 18 is coupled to, and given its circular shape by, membrane gripping ring 20, as shown in FIG. 5. The tensioning of the head 19 for both general and fine tuning is accomplished by means of a circular tensioning ring, or counterhoop 21, which includes an angled cross section member having a generally horizontally extending portion 23 and a generally vertically extending portion 24. Portion 24 has an outside diameter ½ inch (1.27 cm) larger than the outside diameter of ring 20 to enable the ring 21 to capture the ring 20, and the bearing surface 28 of horizontal portion 23 to rest upon the upper surface of the ring 20. The bearing surface 28 is formed to be consistently flat and in direct engagement with the drumhead 19. Thus, the bearing surface 28, drumhead 19, and kettle lip 16 are engaged so as to form a smooth round playing surface. The construction of bearing surface 28 and contact bridge 17 are such that the pressure used to tension the membrane 18 results in a planar playing surface without inconsistencies in its flatness, and within close tolerances of nearly perfect circularity.

Figure 3:
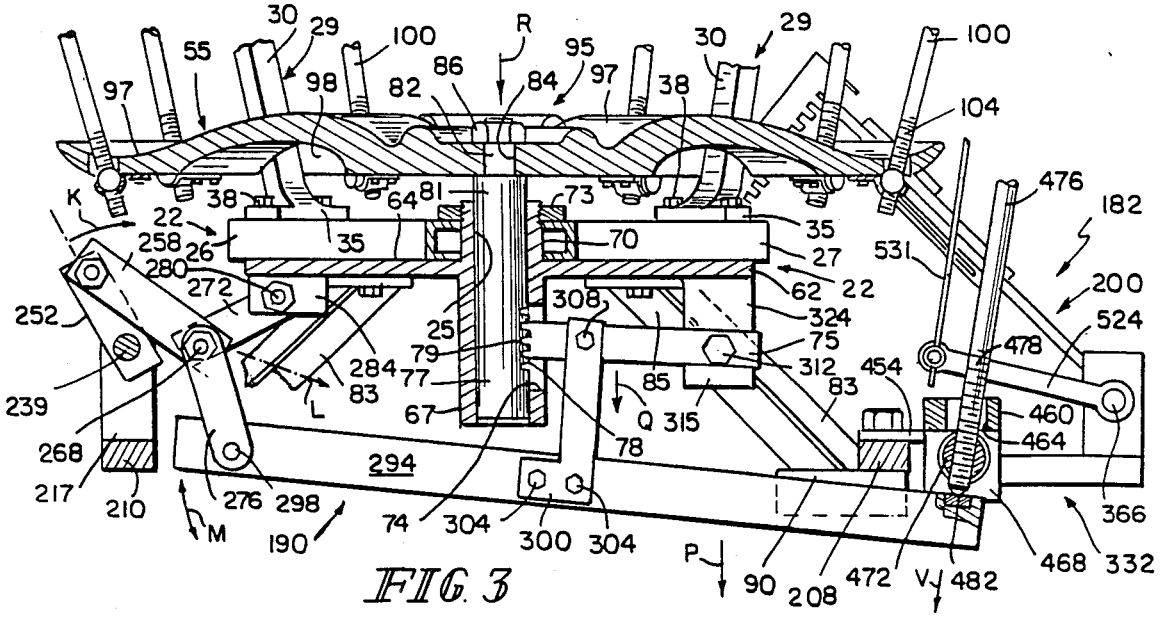
FIG. 3 is a partly broken away sectional view, taken generally along section lines 3—3 of FIG. 2.

The drum 10 further includes four rectangular tubular support arms 22 (FIG. 3). Adjacent arms 22 are perpendicular to each other, with opposed arms 22 generally colinear with each other. The support arms 22 are preferably formed from a long member 26, by then welding shorter, similarly shaped members 27 in opposed, perpendicular relation, at the center of the side surfaces of long member 26. A right circular cross-section receptacle aperture 25 is formed through the walls of long member 26, at the center of its junction with members 26, 27.

A generally upright support strut 29 is carried on each of the four support arms 22. Struts 29 are spaced apart from each other to provide even support for the annular support ring 31 (FIG. 5) which supports the kettle bowl 13. Struts 29 are preferably made of steel or aluminum, either of which is sturdy enough to withstand the stress placed upon the struts 29 by the instrument 10. Each strut 29 includes an elongated shaft portion 30, a base portion 35 at its lower end, and a forked portion 37 at its upper end (FIG. 1). The base portion 35 includes a planar bottom surface which rests on the top surface of one of the four support members 22. The base portion 35 is bolted 38 to a respective arm member 22 to secure the struts 29 to the arms 22. Shims can be interposed between the base 35 and the arm 22, to compensate for any differences in length among the four support struts 29. The shims can be made of a vibration absorbing material such as cloth to isolate the base 35 and support arm 22 from each other.

Each tine 40 of forked portion 37 includes a right-angled top receiving portion 41 for receiving the support ring 31. An Allen screw 46 near the top of each tine 40 attaches the strut 29 to the support ring 31. Each strut 29 is connected to the support ring 31 by the Allen screws 46 in a manner such that the top of the contact bridge 17 of kettle lip 16 is in a plane perpendicular to the vertical axis of bowl 13.

The support ring 31 is formed as a circular strip of metal having an upper beveled edge 58 which is received by the underside of kettle lip 16, a radially outer side surface 60 in contact with the tines 40 of support strut 29, and a diameter substantially equal to that of the contact bridge 17. The support ring 31 is as nearly circular as the lip 16 of bowl 13. Additionally, the highest points of beveled edge 58 form a horizontal circle which engages the interior of lip 16, to support the lip 16 and hence the bowl 13 evenly around the entire circumference of the support ring 31. The width of the support ring's 31 beveled edge 58 at the point of contact with the lip 16 is 0.031 inch (0.79 mm) or less. The support ring 31 supports the kettle lip 16 only at a minimal contact area, thus reducing to a minimum the dampening of the resonance of the bowl 13 itself. The struts 29 and ring 31 are insulated from vibrational contact by a thin, fibrous cushion 61 of exact fit and flatness which is interposed between the tines 40 of the struts 29 and the outer side surface 60 of the supporting ring 31.

A generally circular, disk-shaped base 62 includes a planar upper surface 64 upon which the undersides of the support arms 22 rest. As best illustrated in FIG. 3, the base 62 includes a cylindrical tubular member 67. The tubular member 67 extends vertically both above and below the base member 62. The exterior surface 70 of the tubular member 67 is received within the circular central aperture 25 of the support structure 22, to centrally position the support structure 22 on the upper surface 64 of base 62. The circularity of the exterior surface 70 of the tubular member 67 enables the support arm structure 22, and hence the bowl 13 and drumhead 19, to be rotated about a vertical axis defined by the long axis of tubular member 67. The upper end of tubular member 67 is threaded to receive a nut 73 which secures the support arms 22 to base 62. This assembly technique also permits the bowl 13 to be removed from the base 62 to facilitate transportation of the drum.

The lower portion of the tubular member 67 (i.e. that portion disposed below base 62) includes a guide window 74 through which a lever arm 75 passes for controlling the action of a piston 77 which is vertically movable within tubular guide member 67 to move the instrument's primary tensioning member, spider 55, vertically. Vertical movement of spider 55 adjusts the tension of drumhead 19 membrane 18, thus enabling the musician to change the pitch of the sound produced when the membrane 18 is struck. Preferably, the piston 77 and cylinder 68 within guide 67 are provided with no more than 0.003 inch (0.12 mm) clearance. Self-lubricating couplings (not shown) can be provided in tubular member 67 adjacent piston 77 to facilitate movement of the piston 77 along the interior surface 68 of the tubular member 67. Gear teeth 78 are formed on the side surface of piston 77, and are exposed through window 74 to be engaged by gear teeth 79 provided on lever arm 75.

The shims between base 35 and arms 22 also aid to retain annular support ring 31 in a plane parallel to spider 55 and base 62.

The upper end 81 of piston 77 includes a threaded socket (not shown) for receiving a spider guide shaft 82 which extends colinearly with piston 77 through a central aperture 84 formed in spider 55. Shaft 82 is threaded at its upper end. A nut 86 is threaded onto the upper threaded end of the spider guide shaft 82 to secure the spider 55 to the piston 77. The nut 86 is selectively tightenable on guide shaft 82. By loosening nut 86, and nut 73, the user can rotate the spider 55, support arm structure 22, bowl 13 and drumhead 19 about an axis defined by the long axis of piston 77 and guide shaft 82, to change the relative position of drumhead 19. This feature enables the user to rotate the drumhead 19 when a portion of the drumhead 19 becomes worn or damaged through use. By tightening nuts 86 and 73, the user can securely position the spider 55 and support arm structure 22 to prevent such rotation of drumhead 19.

The base 62 also includes foot connecting means, including four sets of threaded apertures 76 (FIG. 2). A foot structure 80 is attached to plate 62 by means of bolts through threaded apertures 76. Each foot structure 80 includes an elongate angle section 83 to the upper end of which is welded a plate 85, and to the lower end of which is welded a plate 87. The ends of the elongate central portion 83 are angled so that plates 85, 87 are generally parallel to each other, but the foot structure 80 extends outward from the base 62 as well as downward from the base 62. Additional bolts extend through threaded apertures provided in plates 87 to attach casters 92 to the undersides of plates 87. Typically, casters 92 are swivelable and steerable to facilitate movement of the instrument 10, and lockable to permit the user to secure the instrument 10 is a desired position.

Spider 55 includes a central section 95 and four generally "pie" shaped spokes 97 which radiate outwardly from the central section 95. The spokes 97 and center 95 are unitarily formed into spider 55. The struts 29 pass through radially extending slots 98 between the spokes 97 of spider 55. The slots 98 permit a single size spider 55 to be used with drum bodies 13 of different sizes. To accomodate drum bodies 13 of different diameters, struts 29 must usually be repositioned either radially inwardly or radially outwardly on support structure 22. The radially extending slots 98 permit the manufacturer to effect this variable positioning even though the struts 29 extend from below the spider 55 to above the spider 55, and are radially inward from the radially outer ends 112 of spokes 97.

The spider 55 is aluminum. As the spider 55 comprises the master tensioning member of the instrument 10, it must be strong enough to withstand the stress imposed upon it by the stretching of membrane 18 over the contact bridge 17 of kettle lip 16. It can be appreciated by those skilled in the art that the stress imposed on the spider 55 during the tensioning of the membrane 18 can be quite severe.

Each of the four spokes 97 of spider 55 is connected to the tensioning ring 21 and hence drumhead 19 by three circular cross-section tensioning rods 100. The tensioning rods 100 are circumferentially uniformally spaced about the instrument, with clearance relative to the bowl 13. The number of tensioning rods 100 per drum is determined by the diameter of the drumhead 19 of the instrument 10. In the embodiment shown, twelve tensioning rods 100 are used on a drumhead having a diameter ranging from 27–34 inches (68.6–86.4 cm). The number of tensioning rods 100 used per drum of a given diameter is determined by computing an optimal intersection of variables which reflects the overlapping points of tensioning force and the difficulty of tensioning each rod 100 equally to all others. Specifically, the evenness of force exerted on the membrane 18 is proportional to the number of points at which tensioning force is exerted. However, as the number of tensioning points increases, so does the user's difficulty in tensioning each point equally with the other tensioning points. Thus, an optimum between these variables should be struck for each membrane diameter. On drums with diameters of 18 inches (45.7 cm) to less than 27 inches (68.6 cm), eight tensioning rods are sufficient. On drums with diameters 27 inches (68.6 cm) to 34 inches (86.4 cm), twelve tensioning rods are used.

Each tensioning rod 100 includes a threaded lower end 104 which passes through an aperture 108 formed through a respective spoke 97 of spider 55 near its radially outer end 112. The threads of lower end 104 engage a threaded aperture 116 of cylindrical nut 120. The threaded aperture 116 of nut 120 extends generally transverse to the long axis of the nut 120. Preferably, the portion of the underside of spider 55 adjacent the pivot nut is formed to include a part-cylindrical depression in which the nut 120 can nest to enable it to be somewhat pivotable in the part-cylindrical depression. This aids in the operation of the drum. The spider 55 design permits the same size spider 55 to be used for all sizes of drums and with either eight or twelve tensioning rods 100. The part cylindrical depressions maintain uniform spacing of the tensioning rods 100, whether eight or twelve rods are used. Engagement of the nut 120 in a part-cylindrical depression also prevents rotation of the nut 120 on the rod 100 as the rod 100 is rotated to adjust the tension of drumhead 19. A depth caliper guide 124 (FIG. 5) is provided near the lower threaded end 104 of each rod 100. The depth caliper guide 124 facilitates the vertical positioning of the tensioning rods 100 by providing an adjustment reference point, thereby aiding the musician in adjusting all of the tensioning rods 100 so that equal distances are maintained between the spider 55 and the tensioning ring 21 all the way around the drum 10.

Aperture 108 is sized and positioned to maintain the tensioning rod 100 which passes therethrough in a substantially vertical orientation when the tensioning rod 100 is disconnected from the tensioning ring 21. Additionally, the rod 100 can be maintained in its position in aperture 108 by a clip 128 which includes an arcuate portion 132 which captures the nut 120, and an aperture 134 through which the tensioning rod 100 passes. The clips 128 are mounted to the underside of spider 55 by bolts 136. Clips 128 are insulated against the transfer of noise by pads of fibrous material, illustrated in FIG. 5.

The downwardly directed force exerted on ring 21 by the tensioning rods 100 is translated into a downward force on the drumhead through the connection of the tensioning rods 100 with the tensioning ring 21 through counterhoop brackets 140. A counterhoop bracket 140 is provided for each of the tensioning rods 100. Each counterhoop bracket 140 includes a finger 144 which has a horizontal underside surface 148 which contacts on the upper surface of the horizontal portion 23 of ring 21. Each finger 144 includes an aperture through which a countersunk Allen screw 150 passes. The Allen screw 150 threadably engages a corresponding aperture 151 in the horizontal portion 23 of tensioning ring 21 for securing the counterhoop bracket 140 to the tensioning ring 21.

The lower portion 154 of counterhoop bracket 140 is slotted to receive the upper end portion 158 of a tensioning rod 100. The upper end 158 of tensioning rod 100 includes a cylindrical collar 162 which is placed over the end of the rod 100 and secured thereto by a setscrew 166. A square head 168 is formed at the end of each rod 100.

The lower portion 154 of counterhoop bracket 140 includes a radially inner surface 169 which is generally parallel and adjacent to the vertical portion 24 of tensioning ring 21, and a radially outer surface 170. Outer surface 170 includes a generally vertical slot 174 within which the upper end of a respective tensioning rod 100 is housed. An arcuate ridge 178 is formed on the wall of slot 174. Ridge 178 serves as a seat 178 for the collar 162 of tensioning rod 100 for connecting the tensioning rod 100 to the counterhoop bracket 140 and hence to the tensioning ring 21 and drumhead 19. The axially upwardly facing surface of the ridge 178 upon which collar 162 rests is preferably planar and angled slightly from a plane parallel with the spider 55 such that when the collars 162 of the rods 100 rest squarely upon their respective ridges 178, the lower ends 104 of the rods 100 are positioned to extend through their respective apertures 108. Through this arrangement, the force exerted on the drumhead 19 by the spider 55 through the tensioning rods 100 is directed downwardly in a vertical plane through the vertical movement of the pistion 77, spider 55, tensioning rods 100 and drumhead 19 so that there is no radially outwardly directed torque or twist at the tensioning ring 21 and counterhoop brackets 140.

The tensioning rods 100 can be removed from engagement and replaced into engagement with their respective counterhoop brackets 140 by moving the rods laterally through their respective slot 174. This procedure obviates the laborious and time-consuming procedures required for drum disassembly and assembly by some prior art drums. The head assembly 19 may be removed and reseated or changed without retensioning the tensioning rods 100 relative to the spider 55 and, if so desired, without changing the head assembly's 19 position relative to the tensioning ring 21 and kettle bowl 13.

A "cleared" timpano head 19 may be maintained throughout such change with greater ease than in prior art drums. With the instant invention, it is possible to remove a worn drumhead 19 and substitute a new one; to replace a drumhead 19 to place it into the same condition it was in before adjustment (if adjustments were made); or to turn the drumhead relative to the kettle (in addition to permitting rotation of the head and kettle together about the kettle's axis as described above).

A socket wrench is used to engage the square head 168 of each tensioning rod 100 to rotate the threaded end 104 of the rod 100 in the threaded aperture 116 of its respective nut 120 to adjust the tension exerted on the membrane 18 of drumhead 19. An integral key member (not shown) can be provided for this adjustment. Where an integral key member is provided, the key member should be positioned well below the playing surface of membrane 18 or the playing aread delimited by a set of timpani. As can be appreciated, the adjustment of the tensioning rods 100 can be used to differ the tension of different areas of the membrane 18, or to equalize the tension on all areas of the membrane 18.

Figure 4:
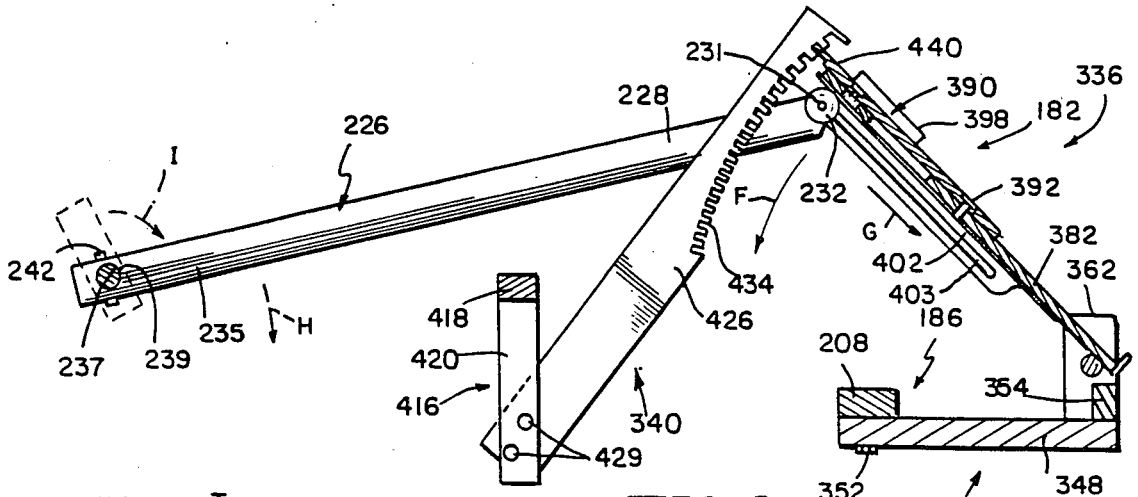
FIG. 4 is a sectional view of the pedal and lever arm of the instant invention, taken generally along section lines 4—4 of FIG. 2.

It is contemplated that the user will normally rotate the tensioning rods 100 to adjust the tension on the membrane 18, and hence the pitch of the drum 10, at times such as when a new drumhead 19 is being fitted onto the instrument 10, or before a performance. During the course of a performance, a tension-adjusting means 182 is provided which enables the user to rapidly and accurately adjust the tension exerted on the drumhead 19, and thus the pitch of the sound produced by striking the membrane 18 of drumhead 19. This tension-adjusting means 182 is best shown in FIGS. 2–4.

Figure 6:
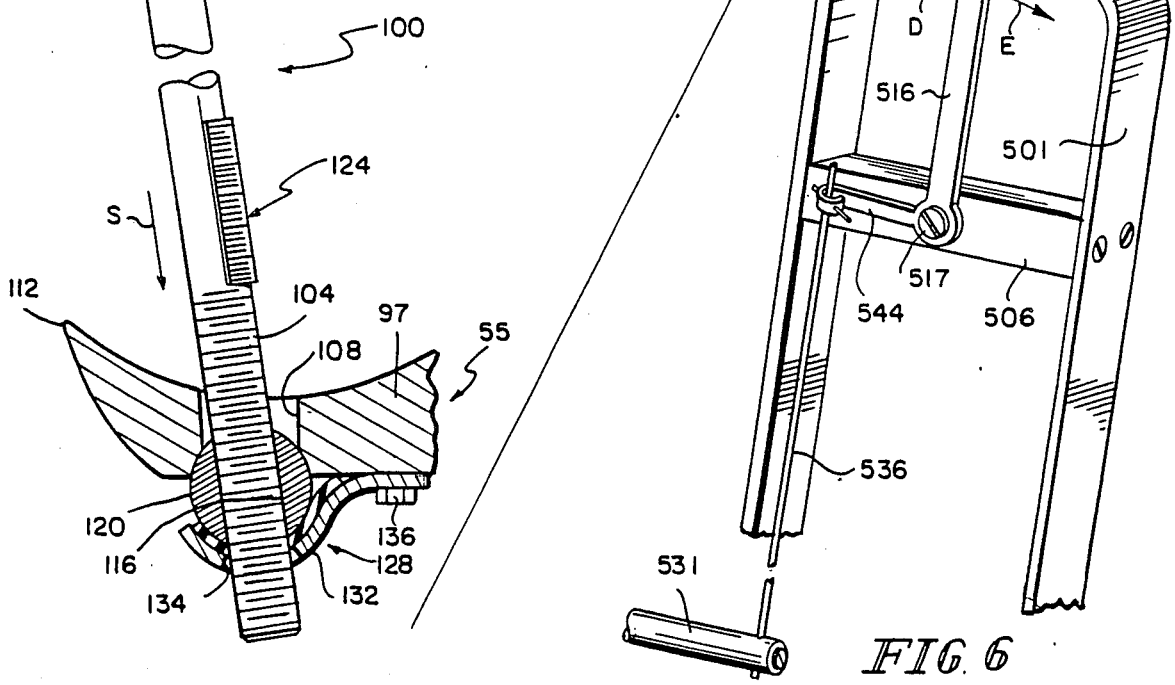
FIG. 6 is a perspective view of the visual tension indicator.

Tension-adjusting means 182 comprises a frame 186 for supporting the tension-adjusting means 182 and a lever system 190 which is supported by frame 186. Lever system 190 is provided for moving the piston 77 which, through its engagement with spider 55, tensioning rods 100, and counterhoop tensioning ring 21, adjusts the tension exerted on membrane 18 of drumhead 19. The tension-adjusting means 182 also includes a pedal mechanism 196, which is best shown in FIGS. 2 and 4. The pedal mechanism 196 enables the musician to actuate the lever system 190 by foot pressure and hence change the tension exerted on drumhead 19. A hand-operable lever system actuating means 200, which is best shown in FIGS. 1–3, enables the musician to actuate the lever system 190 to change the tension exerted on drumhead 19 by movement of the musician's hand. The hand-operable lever system actuating means 200 is best utilized for enabling the musician to make fine adjustments to the pitch of the drumhead 19. A visual indicating means 204, which is best shown in FIGS. 1 and 6, is provided for visually indicating to the musician the pitch setting of the drum 10.

The frame 186 includes a first main frame member 208 which extends between, and is fixed to the top surfaces 90 of, the plates 87 associated with two of the feet 80. A second main frame member 210 extends generally parallel to first frame member 208 between channel members 87 of the other pair of feet 80. Bolts 216 fix the frame members 208, 210 to the channel members 87. The frame members 208, 210 are aluminum. Cross frame members (not shown) can be fixed between the main frame members 208, 210 and be disposed generally perpendicularly thereto to provide additional support for frame 186 if necessary. Frame member 210 is provided with a pair of spaced, parallel upstanding legs 217.

Lever system 190 is supported by the frame 186 and includes a pedal-actuable, rockshaft actuating first lever arm 226. The first end 235 of lever arm 226 includes an aperture 237 which receives a rockshaft 239. The second end 228 of lever arm 226 includes a guide roller follower 232 which is rotatably journaled by an axle 231 onto the free end 228. A pin 242 fixes the first end 235 of lever arm 226 to the rockshaft 239 so that the lever arm 226 pivots on the rockshaft 239 axis to rotate rockshaft 239. Rockshaft 239 is rotatably journaled in aligned apertures (not shown) in upstanding legs 217 of second frame member 210. Bearings can be provided in such apertures to facilitate rotation of the rockshaft 239.

Collars 248 are fixed to rockshaft 239 by setscrews (not shown) to maintain the rockshaft 239 in its proper orientation with respect to legs 217, and to prevent the rockshaft 239 from becoming disengaged from legs 217 by sliding laterally out of the apertures.

A first crank arm 252 is fixed to rockshaft 239. A key or pin (not shown) is provided for fixing crank arm 252 to the rockshaft 239. Parallel crank arms 258 are pivotally coupled to crank arm 252 by a pivot pin 262 which passes through aligned apertures in crank arm 252 and crank arms 258. A pivot pin 268 extends through apertures (not shown) in crank arms 258 and an aperture in a pivot guide link 272 to couple the pivot guide link 272 pivotally with the crank arm 258. Thus, the crank arms 258 are pivotally coupled both to the crank arm 252 and to the pivot guide link 272. The pivot guide link arm 272 restricts and defines the movement of crank arms 258, so that, as shown in FIG. 3, clockwise movement of crank arm 252 is transmitted into generally downward movement by crank arms 258. Pivot guide link 272 is pivotally mounted to base 62 by an inverted U-shaped channel member 284 by a pivot pin 280 which passes through aligned apertures in the pivot guide link 272 and the vertical legs of channel member 284. Channel member 284 is fixed to the underside of base 62. Pivot pin 268 also pivotally couples crank arms 258 and guide link 272 to a crank arm 276. A second crank arm 276 pivotally engages a main transmission lever arm 294. A pivot pin 298 extends through aligned apertures in crank arm 276 and main transmission arm 294 to pivotally couple the arms together.

Upstanding, L-shaped brackets 300 are fixed to both sides of transmission arm 294 by bolts 304. A pin 308 pivotally connects the L-shaped brackets 300 to lever arm 75, to translate vertical movement of arm 294 into vertical movement of lever arm 75. As discussed, lever arm 75 includes teeth 79 which engage teeth 78 on piston 77, so that movement of lever arm 75 results in movement of piston 77. Lever arm 75 extends through a vertically extending slot in, and is pivotally mounted by pivot pin 312 to, a housing 315 integral with base 62.

The pedal mechanism 196 includes a platform 332 (FIG. 4) pivotally supporting a pedal 336 which is actuable by the user's foot for tensioning the drum head 19, and means 340 for fixing the pedal 336 position for enabling the user to set the pedeal mechanism 196 at a predetermined position, and hence fix the drumhead 19 at a predetermined tension to achieve a desired pitch when the membrane 8 is struck. Although the pedal mechanism 196 is shown on the right side of the instrument 10 with respect to the musicians playing position, it will be understood by those skilled in the art that the pedal mechanism 196 can be disposed on the left side of the drum 10 according to the user's preference.

The platform 332 includes spaced, parallel frame members 348 which are fixed to frame member 208 and extend generally perpendicular thereto. Bolts 352 fix frame members 348 to frame member 208. A base plate 354 extends between frame members 348 in spaced, parallel relation to frame member 208. Base plate 354 includes spaced, upstanding legs 362 which are attached to the top of the base plate 354. Legs 362 include aligned apertures (not shown) which pivotally receive a pedal rockshaft 366. Collars 370 are fixed to the pedal rockshaft 366 to fix the lateral position of rockshaft 366 to prevent the rockshaft 366 from becoming disengaged from legs 362. Bearings can be interposed between the rockshaft 366 and legs 362 to facilitate pivotal movement of rockshaft 366.

Rockshaft 366 is fixed by Allen screws 378 to a heel plate portion 382 of pedal 336. Heel plate 382 is generally planar and includes a wider heel portion and a narrow arch portion 386 which extends generally colinear with the long axis of pedal 336, along the entire length of pedal 336.

A forefoot plate 390 having a narrow arch portion and a wider toe portion is adjustably mounted to heel plate 382 by a swivel pin 392, which permits the forefoot plate 390 to swivel about the axis of the swivel pin 392 laterally in an arc as indicated by arrows B and C (FIG. 2). The forefoot plate 390 has three detends, one left, one center and one right provided at its surface adjacent heel plate 382. Heel plate 382 includes a threaded bore in which a spring-loaded ball is captured by a threaded plug. The ball snaps into engagement with one of the detents to secure the forefoot plat 390 selectively in either the left, center or right position with respect to the heel plate 382. As best shown in FIG. 2, the axis of swivel pin 392 is generally perpendicular to the plane of upper foot engaging surface 400 of pedal 336. Side members 398 extend upwardly above the upper, foot engaging surface 400 of forefoot plate 390. Side members 398 help retain the user's foot on the upper surface 400 of the forefoot plate 390. The side members 398 also provide a vertical surface against which the user can exert a force to cause the forefoot plate 390 to swivel about the axis of swivel pin 392. One of the side members 398 is fixed and the other side member 398 is adjustable outward and inward so that the usable width of forefoot plate 390 can be adjusted to the musician's foot size. Attachment of the adjustable side member 398 is by means of springs which urge the adjustable side member outward away from forefoot plate 390 and screws which hold adjustable side member 398 onto forefoot plate 390.

A slotted guide 402 is fixed to the underside of heel plate 382, and extends generally the entire length of the pedal 336. The guide 402 comprises a runway surface upon which the guide roller 232 rolls when the pedal 336 is depressed and released, thus serving as a movable fulcrum. The upstanding rib of the guide 402 is slotted at 403 and the axle 231 of guide roller 232 extends through the slot 403 to fix the relative positions of guide roller 232 and slot 403. Channel 402 and guide roller 232 cooperate to create a movable fulcrum which increases the mechanical advantage of the lever system 190, which serves to result in a greater force being applied to the lever system 190 by the player's foot through the downward are travelled by the pedal 336.

The movable fulcrum permits a player to exert a substantially equal amount of force through the arc of the pedal 336, while the lever system 190 exerts an increasing amount of force on drumhead 19. This eliminates the need for increasing force to perform the necessary work to achieve a tighter drumhead 19 and higher musical pitch as the pedal 336 is depressed. Prior to the instant invention, the player had to use more force for each successively higher pitch due to the increasing tightness of the drumhead 19. The increasing tightness of the drumhead 19 required the player to move a pitch pedal against increased drumhead tension. The movable fulcrum of the instant invention increases the mechanical advantage of the lever system 190, and results in the player being able to apply a smooth, even force over the entire playable range of the drum 10. Additionally, the pedal 336 is disposed at an angle relative to the ground to have only a moderate slope in its median position. This feature better enables movement of the pedal through the pivoting of the musician's ankle joint, rather than through leg and hip joint movement, to move the pedal 336.

A shim can be interposed between the parallel frame members 348 and the base plate member 354 to raise the heel end of pedal 336, and thus decrease the angle of the pedal 336 relative to the ground to accomodate users of different heights, different playing styles (e.g., standing or sitting), various multi-percussion set-up demands, or different desired combinations of ankle and leg movement in the depression and release of the pedal 336.

The means 340 for locking the pedal 336 in position includes an L-shaped base plate 416 having a horizontally disposed leg 418 which is fixed to the underside of base 62, and a vertically disposed leg 420. A positioning arm 426 is fixedly attached to the vertically disposed leg 420 by bolts 429. Positioning arm 426 is generally set at about a 25° angle to vertical, and includes a pedal position fixing portion such as an arcuate row of teeth 434. The curve of the arc is parallel with the arc described by the distal end of forefoot plate 390 of pedal 336, to maintain the teeth 434 at an approximately equal spacing from the distal end of the forefoot plate 390 throughout the arc described by the pedal 336 as it is depressed and released. A tooth plate 440 is formed on, or fixed to, the distal end of the forefoot plate 390 and extends generally colinear with the long axis of pedal 336. The tooth plate 440 is sized and positioned to be engageable with a tooth of the arcuate row of teeth 434 to enable the user to engage the tooth plate 440 and hence the pedal 336 with a tooth 434 and fix the position of the pedal 336. In a preferred embodiment, the tooth plate 440 is selectively attachable to the forefoot plate 390 to enable a user to replace the tooth plate 440 if it becomes worn. The tooth plate 440 is engageable with a selected tooth 434 when the ball in the heel plate engages the center position detent in the forefoot plate 390.

The hand-operable lever-actuating means 200 enables the user to adjust the tension of the drumhead 19 over a continuum to make fine adjustments in the pitch of the drumhead, or to finely tune the instrument between the broader pitch stops defined by the positions of the teeth 434 of the pedal mechanism 196.

The hand-operable lever-adjustment means 200 includes a platform 452 having a pair of spaced, parallel frame members 454 which are fixed by bolts 458 to frame member 208, and extend generally perpendicular thereto. A cross brace frame member 460 is fixed to frame members 454, and extends between the frame members 454. Cross brace frame member 460 is disposed generally perpendicular to frame member 454 and generally parallel to first main frame member 208. Cross brace member 460 includes a central aperture 464 directly above the lever arm 294. Legs 468 extend vertically downwardly from cross brace 460 and include aligned apertures (not shown) through which is journaled a pivot nut 472. Pivot nut 472 has a threaded aperture which is disposed transversely to the pivot nut 472 long axis.

An adjustment rod 476 has a threaded lower portion 478 which passes through central aperture 464 in cross brace member 460, and is threadably received in pivot nut 472. The lower end 482 of adjustment rod 476 includes a spherical bearing which urges against the surface of a stainless steel insert provided in the upper surface of transmission arm 294, so that vertical movement of adjustment rod 472 moves lever arm 294 which, through bracket 300, lever 75, piston 77, spider 55, rods 100, and counterhoop tensioning ring 21, adjusts the tension, and hence changes the pitch of membrane 18. The position of adjustment rod 476 is changed by the rotation of adjustment rod 476 in pivot pin 472. To adjust the rod 476, the user rotates the adjustment rod 476 by turning a socket wrench 492 which has a squared socket 496 which receives a squared head at the top of the adjustment rod 476. Adjustment rod 472 is generally similar in configuration to tensioning rod 100.

The means 204 for visually indicating the pitch setting of the drum 10 includes an inverted U-shaped frame having legs 500, 501 which extend upwardly to a point just below the support ring 31, and are fixed to the frame members 454 of platform 452 by bolts 502 (FIG. 1). Legs 500, 501 are joined by a cross bar 506 which maintain the support members 500, 501 in a spaced, parallel relation. The central portion of the U includes an arcuate, tension-indicating gauge surface 508. The tension-indicating gauge surface 508 includes markings 512 to assist the user to read the position of a pointer 518 of a gauge needle 516. Preferably, the gauge surface 508 can be made of a markable material, upon which the user can mark, such as with crayons, one or more points corresponding to one or more selected pitches of the head 19. This enables the user to reproduce this selected pitch at a later time.

As is shown in FIG. 1, the gauge surface 508 is disposed only slightly lower than the playing surface of membrane 18, adjacent the key 492 of adjustment rod 476, and just to the left of pedal 336. The proximal placement of the membrane 18 visual indicator gauge surface 508, key 492, and pedal 336 enables the user to make changes in the tension and hence pitch of the drum through the foot-operable 196 actuating means while being able to keep track of the amount of tension exerted on the membrane 18 by reading the position of the gauge surface 508, without being distracted from the conductor, musical notation, or the playing surface of the membrane 18.

Gauge needle 516 is pivotally attached to cross bar 506 by a pivot pin 517. The gauge needle 516 is moved along gauge surface 508 in response to movement of pedal 336. The movement of pedal 336 rotates pedal rockshaft 366. The rotation of pedal rockshaft 366 rotates a crank arm 524 which is fixed to the rockshaft 366. When viewed as in FIG. 3, the depression of the pedal causes the crank arm 524 to rotate counterclockwise. This moves a transmission arm 531 vertically downwardly.

As best shown in FIG. 6, a link 536 is secured to the transmission arm 531 near the end of the transmission arm 531 opposite to the end upon which crank arm 524 is journaled. Downward movement of transmission arm 531 causes a downward movement of link 536, which causes a downward movement of a crank arm 544 on the needle 518 movement. The downward movement of link 536 thus causes indicator needle 516 to move in a counterclockwise direction, as viewed in FIG. 6, as indicated by arrow D. As can be appreciated, when pedal 336 is released the indicator needle 516 will move in a clockwise direction as indicated by arrow E.

In operation, the lever system 190 and foot-operable lever system actuating means 196, operate as follows.

Referring now to FIG. 2, wherein the pedal 336 is viewed from the top, the user places the heel portion of his foot on the heel plate 382 of the pedal 336, and his forefoot on the upper surface 400 of forefoot plate 390. The user then moves the pedal in one of the directions indicated generally by arrows B and C to disengage the tooth 440 from the arcuate row of teeth 434 (FIG. 4). Because the forefoot plate 390 is swivelable both to the left and the right of the arcuate row of teeth 434, engagement and disengagement of the tooth 440 with teeth 434 is facilitated for different users who may feel more comfortable moving the forefoot plate 390 to one side or the other. When the tooth 440 of forefoot plate 390 is disengaged from teeth 434, the user depresses the pedal 336 to raise the pitch of drumhead 19. The pedal is depressed in an arc indicated generally by arrow F, as shown in FIG. 4. As the pedal 336 is depressed, guide roller 232 rolls along the runway surface of guide channel 402 in the direction indicated generally by arrow G, to create a movable fulcrum for aiding the user to depress the first lever arm 226. As the user depresses the pedal 336, and thereby moves the guide roller 232 along guide channel 402, lever 226 is moved downwardly in a direction indicated generally by arrow H. The fixed attachment of lever arm 226 to rockshaft 239 causes the rockshaft 239 to rotate in a clockwise direction as indicated generally by arrow I.

As best shown in FIG. 3, the clockwise rotation of rockshaft 239 causes crank arm 252 to move in a clockwise direction, as indicated generally by arrow K. The clockwise rotation of crank arm 252 causes crank arms 258 to move in a generally laterally and downwardly direction as indicated by arrow L. Through the pivotal connection of crank arms 258 to guide link member 272 and crank arm 276, crank arm 276 is cuased to move in a generally downwardly direction as indicated by arrow M. The pivotal connection of crank arm 276 to lever transmission arm 294 causes the lever transmission arm to move generally downwardly and arcuately as indicated by arrow P. The downward movement of lever transmission arm 294 moves lever arm 75 downwardly as indicated generally by arrow Q. Lever arm 75, through its connection to piston 77 by teeth 78, 79, moves piston 77 downwardly inside cylindrical tubular member 67. Piston 77, through its connection to guide shaft 82 and nut 86, moves spider 55 vertically downwardly in a direction indicated generally by arrow R.

Referring now to FIG. 5, the downward movement of spider 55 causes the tensioning rods 100 to move downwardly as indicated by arrow S. The downward movement of tensioning rods 100 exerts a downward force on counterhoop brackets 140 which in turn exerts a downward force on counterhoop tensioning ring 21 and membrane 18 gripping ring 20. The gripping ring 20 is forced generally vertically downwardly in a direction indicated by arrow T. The spider member 55 moves all tensioning rods 100 downwardly. The downward movement of spider 55 and tensioning rods 100 moves the membrane gripping ring 20 downwardly. The downward movement of gripping ring 20 exerts a lateral force on membrane 18 in a direction indicated generally by arrow U, stretching the membrane 18 across the contact bridge 17. As the downward force on gripping ring 20 is exerted substantially equally about the circumference of the ring 20, the lateral forces exerted on the membrane 18 will be substantially equal throughout the circumference of the membrane 18. This equality of exerted force results in the tension on membrane 18 being changed equally at all points, which enhances the ability of the musician to achieve a desired change in pitch from the membrane 18. Additionally, because the pedal mechanism 196 and hand-operable lever-actuating means 200 activate lever transmission arm 294, through which piston 77 exerts a straight line force on the master tensioning member, spider 55, the initial adjustment made to the membrane 18 through the adjustment of tensioning rods 100 will be maintained throughout the range of tension applied by the pedal mechanism 196 and hand lever system actuating means 200. This advantage is not available with prior art systems which pulled their master tensioning members arcuately downwardly to adjust the tension of the drumhead 19. The arcuate movement of prior art master tensioning members often resulted in the over-tensioning of some portions of prior art drum's membranes, and the under-tensioning of other portions of their membranes.

When the user achieves a desired pitch through the movement of pedal 336, the forefoot plate 390 can be swiveled to a position wherein the tooth 440 engages one tooth of the arcuate row of teeth 434 of positioning arm 426. The engagement of the tooth 440 with the teeth 434 causes the desired tension to be maintained on membrane 18, thereby enabling the user to reproduce the desired sound when striking the membrane 18. It can be appreciated that when the pedal 336 is released, and allowed to move upwardly, the above-described sequence is reversed. Since the membrane 18, when in use, is always under tension, the tendency of the membrane 18 is to exert a radially inwardly directed force on the gripping ring 20 to cause the tensioning ring 21, tensioning arms 100, spider 55, and piston 77 to be pulled upwardly. Therefore, as the pedal 336 is connected to the piston 77 through the pedal mechanism 196, it can be appreciated that the natural tendency of the pedal 336, when not engaged with teeth 434 of the positioning arm 426, is to move in a clockwise (upward) direction (when viewed as in FIG. 4).

The hand-operable lever actuating means 200 operates as follows. Referring now to FIGS. 1 and 3, the user rotates key 492 in a clockwise direction to rotate adjustment rod 476 in a clockwise direction. The clockwise rotation of adjustment rod 476, as viewed from above the drum, moves the rod 476 downwardly, through the threaded engagement or rod 476 to pivot nut 472. The downward movement of rod 476, through the contact of the lower end 482 of rod 476 with the lever transmission arm 294, moves the lever transmission arm 294 downwardly in a direction indicated generally by arrow V. The downward movement of lever transmission arm 294 moves the bracket 300, lever arm 75, and piston 77 downwardly in the same manner as they are moved downwardly when actuated by the downward movement of pedal 336. As can be appreciated, the counterclockwise rotation of the adjustment rod 476 raises the adjustment rod 476 downwardly, causing the above-described sequence to be reversed, and hence the tension exerted on membrane 18 to be decreased.

It should be understood that, in addition to release of the tension on the drumhead by rotating tensioning rods 100, the user can release the tension on the spider 55 by moving the pedal 336 to its lowest tension position and/or by releasing the tension applied by the fine tuning adjustment rod 476 (depending upon the actual positions of tensioning rods 100, one or both of these adjustments may be necessary). When tension is released from spider 55, the user can lift each tensioning rod 100 from its counterheep bracket 140 by unseating its collar 162 and pulling the rod 100 from its slot 174. If the adjustments to spider 55 were not enough to relieve the tension on tensioning rods 100 so that they could be removed, nut 86 can also be loosened. (If nut 86 must be loosened to effect disassembly, then nut 86 was too tight when the drum was assembled.) The tensioning rods 100 thus do not have to be completely removed from spider 55 to disassemble the drum. If the drum is in proper adjustment, the tensioning rods 100 should not have to be retensioned or disengaged from the spider 55. Releasing of the tension provided by the pedal 336 from the spider 55 should be enough to permit disassembly.

Figure 9:
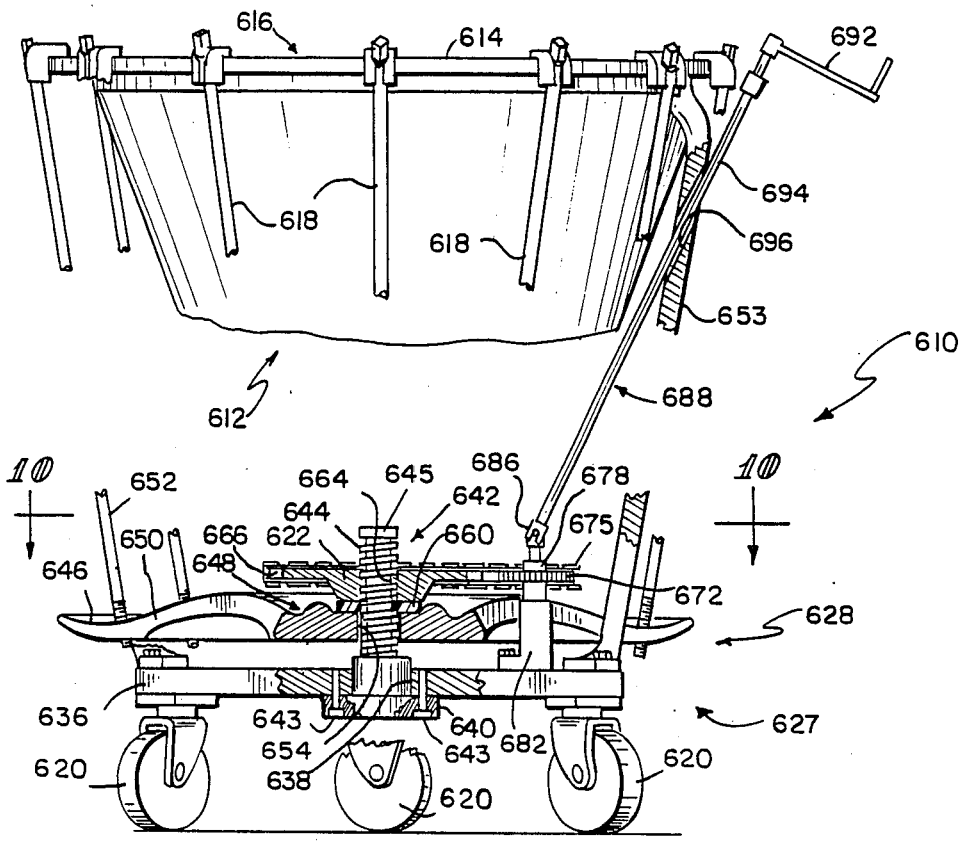
FIG. 9 is a fragmentary side elevational view of a kettledrum constructed according to the present invention.
Figure 10:
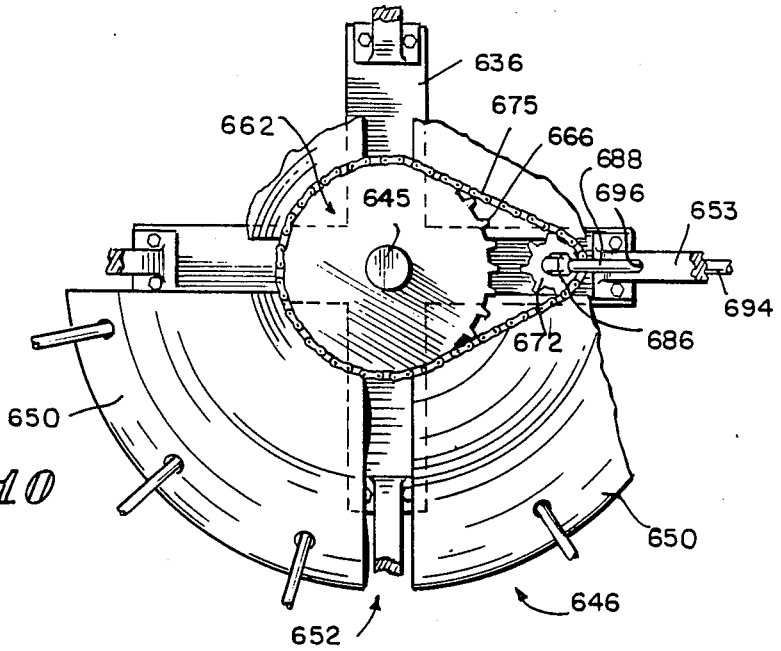
FIG. 10 is a fragmentary sectional view, taken generally along section lines 10—10 of FIG. 9.

Another embodiment 610 of the percussion instrument is shown in FIGS. 9 and 10. Percussion instrument 610 includes a body 612, a percussion head 614 which is supported by the body 612, a counterhoop and head tensioning arrangement 616, tensioning rods 618 and casters 620 which are generally similar to their counterparts in percussion instrument 10, shown in FIGS. 1–8. Percussion instrument 610 however includes a different base structure 627 and different means 628 for exerting a variable tension on the percussion head 614 than the embodiment shown in FIGS. 1–8. Although base 627 is different than the base 62 and support structure 22 arrangement shown in the embodiment of FIGS. 1–8, the means 628 for exerting a variable tension on the percussion head 614 which is shown in FIGS. 9 and 10 is adaptable for use on the base 62 and support structure 22 shown in FIGS. 1–8. One advantage of this interchangeability is that the user can own percussion instruments having both crank actuable and pedal actuable variable tension exerting means without being forced to purchase two sets of drum bodies, percussion heads, counterhoop and tensioning arrangements and tensioning rods.

Base 627 comprises a cross-shaped base structure 636 which is generally similar in configuration to support arm structure 22 (best shown in FIGS. 1 and 2). Structure 636 provides a central aperture 638, and four radially outwardly extending arms, each at 90° angles to adjacent arms. A caster 620 or foot (not shown) is mounted to the underside of each arm. A mounting collar 640 having an upwardly opening aperture (not shown) extends through central aperture 638. Bolts 643 are provided for attaching the mounting collar 640 to the underside of base support structure 636. A threaded means such as a worm 642 is fixed in the upward opening aperture (not shown) of the mounting collar 640 to maintain the worm 642 in a generally upright position and to prevent the worm 642 from rotating in the aperture. Worm 642 includes a threaded radially outer surface 644 and may include a top cap 645.

A master tensioning member such as a spider 646 is placed above the base member 636. Spider 646 is generally similar, and can be identical to spider 55 (best shown in FIGS. 1 and 3). Spider 646 includes a disk shaped central portion 648 and four radially outwardly extending spoke portions 650. Adjacent spoke portions 650 define spaces 652 (FIG. 10) therebetween, through which support struts 653 pass. Support struts 653 are generally similar in structure and function to support struts 29 shown in FIGS. 1–3. The radially outer portion of each spoke portion 650 also includes a plurality of apertures for receiving the lower ends of tensioning rods 618.

The spider 646 includes a generally vertical, central aperture 654 for receiving the worm 642. Clearance is provided between the central aperture 654 and threaded outer surface 644 of worm 642. This clearance is sufficient to permit the tensioning member 646 to move vertically along the worm 642 without engaging the threads of threaded outer surface 644. However, the clearance between the threaded outer surface 644 and central aperture 654 is small enough to prevent any substantial wobble of the tensioning member 646 on the worm 642.

A thrust bearing 660, illustratively of nylon or brass, includes a central aperture for receiving worm 642, and overlies the upper surface the central portion 648 of spider 646. The thrust bearing 660 provides a bearing surface between the upper surface of spider 646 and the lower surface of a driven sprocket 662, to reduce the friction therebetween. Sprocket 662 includes a threaded central aperture 664 and a radially outer surface 666 having a plurality of teeth.

The threaded central aperture 664 of the sprocket 662 engages the threaded outer surface 664 of worm 642 so that the rotation of sprocket 662 about the worm 642 causes the sprocket 662 to move vertically relative to the worm 642. This vertical movement of sprocket 662 is translated through bearing 660 into vertical movement of spider 646 to tune percussion head 614.

A second smaller driving sprocket 672 is disposed radially outwardly of the driven sprocket 662, and is preferably vertically positioned at approximately the vertical midpoint of the vertical path of travel of sprocket 660 on worm 642. An endless chain 675 couples driving sprocket 672 and driven sprocket 662 to translate rotation of the driving sprocket 672 into rotation of the driven sprocket 662. An axle 678 is provided on driving sprocket 672. Rotation of the axle 678 rotates the driving sprocket 672. The axle 678 is rotatably mounted in the upper portion of a sprocket mounting bracket 682. Bracket 682 is mounted to the upper surface of an arm of base structure 636, radially inwardly from support strut 653. Bracket 682 extends through a space 652 between adjacent spokes 650 of spider 646.

A universal joint 686 couples the axle 678 to the lower end of a driving rod 688. The upper end of driving rod 688 is configured similarly to the upper end 168 of tensioning member 100 (FIG. 5) to fit into a socket provided in a removable crank 692. Alternatively, the crank 692 can be a non-removable crank (not shown). The upper end of rod 688 is positioned generally adjacent to, and at the same general height as percussion head 614 to facilitate tuning. One of the support struts 653 includes an angled aperture 696 through which the intermediate portion 694 of rod 688 passes. The angle and position of aperture 696 maintain the rod 688 in a use orientation and maintain the upper end of rod 688 generally adjacent to the percussion head 614.

To change the tension created by the tensioning spider 646 on the percussion head 614, the use rotates crank 692, which rotates rod 688. The rotation of rod 688 rotates sprocket 672. The rotation of the driving sprocket 672 is transmitted through chain 675 to driving socket 662. The rotation of the driven sprocket 662 moves it vertically along worm 642, through the engagement of the threaded central aperture of driven sprocket 662 and the threaded outer surface 644 of worm 642. The vertical movement of driven sprocket 662 either exerts or relieves vertical force on spider 646, to move spider 646 vertically. The vertical movement of spider 646, through tensioning rods 618 varies the tension exerted on percussion head 614. As will be appeciated, the crank can be rotated one direction (clockwise as viewed in FIG. 10) to move the sprocket 662 downwardly, to cause a greateer tension to be exerted on percussion head 614 to raise the pitch of the percussion head 614, and can be rotated in the opposite direction (counterclockwise as viewed in FIG. 10) to move the sprocket 662 vertically upwardly, to reduce the tension on percussion head 614.

Figure 11:
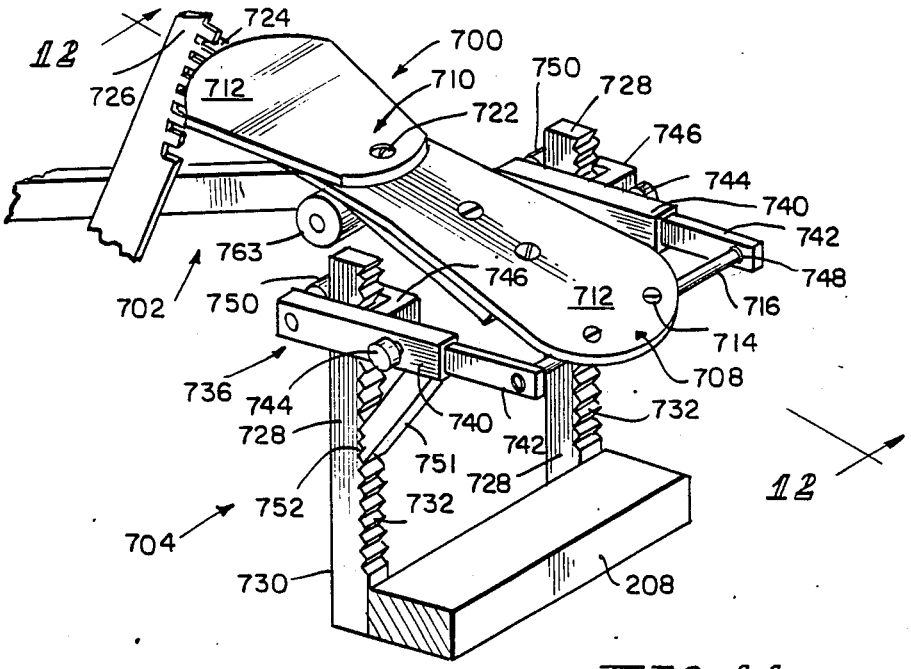
FIG. 11 is a perspective view of a pedal and pedal mounting mechanism constructed according to the invention.
Figure 12:
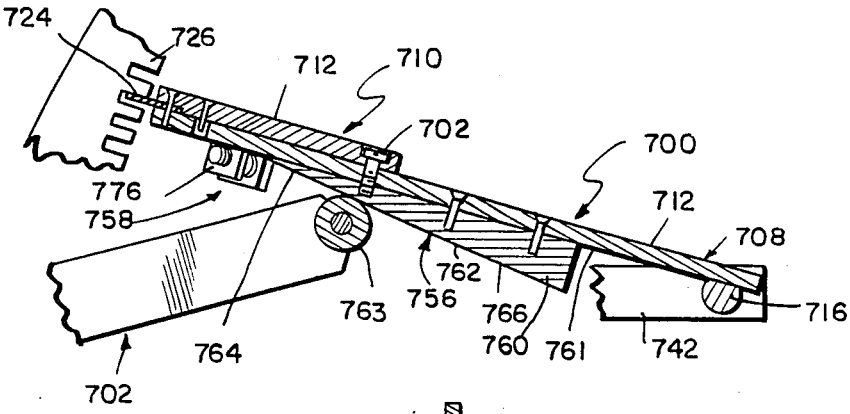
FIG. 12 is a fragmentary sectional view taken generally along section lines 12—12 of FIG. 11.
Figure 13:
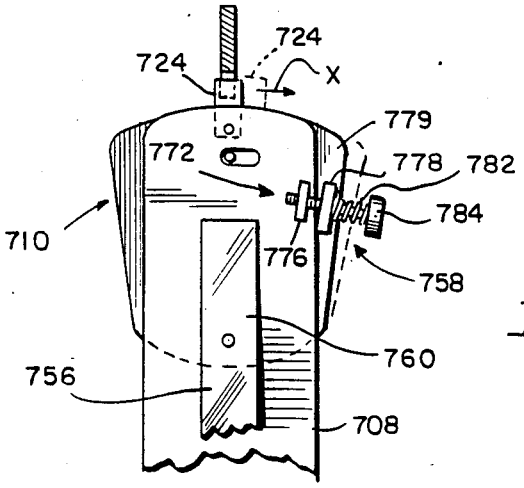
FIG. 13 is a fragmentary bottom plan view of the pedal of FIGS. 11 and 12.

Another embodiment 700 of the foot actuable pedal for actuating the variable tension exerting means 702 of the percussion instrument 10 of FIGS. 1–8 is shown in FIGS. 11–13. Pedal 700 is designed for use primarily with the embodiment of the percussion instrument 10 shown in FIGS. 1–8, and can be used in lieu of the pedal 336 mechanism shown in FIGS. 1–8.

Pedal 700 is mounted on a movable pedal mechanism 704, which permits the user to vary the location of the pedal 700 relative to the frame of the drum 10. Pedal 700 includes a heel portion 708 and toe portion 710. Pedal 700 provides a user engageable top surface 712. Bolts or screws 714 are disposed near the proximal end of the heel portion 708 for fixing the pedal 700 to a pivotable rod member 716. A swivel bolt or screw 722 permits the toe portion 710 to swivel relative to the heel portion 708 about an axis generally normal to the plane of the user engageable top surface 712. A tooth 724 is disposed at the distal end of toe portion 710 for selective engagement in the teeth of a position fixing means 726. The structures and functions of these components of pedal 700 are generally similar to those of the corresponding components of pedal 336 shown in FIGS. 1–8.

Mechanism or platform 704 is provided for enabling the user to change the location of the pedal 700. The user can change both the vertical and horizontal locations of the pedal 700 to place the pedal 700 in a position most comfortable for the user. By changing the horizontal and vertical location of the pedal 700, the user can also change the mechanical advantage somewhat, depending on whether the user uses her ankle or her leg or some combination thereof. The change in mechanical advantage is also dependent on the height at which the player exerts force, for players of different heights engage their leverage differently. Mechanism 704 includes a pair of spaced, parallel upright members 728 which are fixed to a frame member of the instrument 10, illustratively, frame member 208. The relative location of frame member 208 is best illustrated in FIG. 2.

Each upright vertical member 728 each includes a smooth vertical surface 730 and a vertical array of teeth 732 on the vertical surface opposite to smooth vertical surface 730. Mechanism 704 also includes a pair of spaced, generally horizontal members 736 which are movable relative to the vertical members 728. Horizontal members 736 are telescoping horizontal members, with each having a sleeve portion 740 which slidably receives a telescoping arm 742. Arm 742 can be moved inwardly or outwardly relative to sleeve 740 to vary the horizontal location of pedal 700. An adjustment knob 744 is provided for permitting the user to fix the relative positions of the sleeves 740 and telescoping arms 742.

Rod 716 is pivotally journalled at its ends to the telescoping arms 742, near the ends of the telescoping arms 742. A bushing 748 is provided between the pivotal rod 716 and the telescoping arm 742 to reduce the friction between the telescoping arm 742 and rod 716.

Means such as a downwardly and rearwardly angled arm 751 is fixed at one end to sleeve 740. Vertically disposed teeth 752 are formed on the opposite end of each angled arm 751 for engaging the teeth 732 of the vertical members 728. The engagement of the teeth 752 of arms 751 and the teeth 732 of vertical members 728 maintains the horizontal members 736 in a fixed relation to the vertical members 728.

A navigation box 746 is provided for guiding each of the horizontal members 736 in its path of travel along its respective vertical member 728. A roller 750 is journalled along one side of each navigation box 746 to facilitate the movement of each horizontal member 736 along its respective vertical member 728.

The user of the percussion instrument 10 uses the mechanism 704 to fix the location of the pedal 700 at the beginning of a performance and maintain the pedal 700 in this fixed location throughout the performance. However, the location of the pedal 700 can be adjusted quite easily by the user during a performance. To adjust the vertical location of the pedal 700, the user places a toe under the pivot rod 716 and lifts upwardly to disengage the teeth 752 of angled arms 751 from the teeth 732 of vertical members 728. The user's foot can then be moved vertically upwardly or downwardly to adjust the vertical locations of both horizontal members 736 relative to their respective vertical members 728. To adjust the horizontal location of the pedal 700, the user turns adjustment knobs 744, to a point at which the telescoping arms 742 move freely relative to sleeves 740. When the user has placed the telescoping arm 742 in a desired position, the adjustment knobs 744 are tightened to fix the positions of the telescoping arms 742 to maintain the desired horizontal location of pedal 700.

As best shown in FIG. 12, pedal 700 includes a guide means 756 which differs from the guide means 402 shown in FIG. 4, and a biasing means 758 not present in the pedal 336 structure shown in FIG. 4. Guide means 756 comprises a wedge or inclined plane 760 which is fixed to the bottom surface 761 of the heel portion 708 of pedal 700. The wedge 760 includes a lower surface 762 which is inclined relative to the user-engageable surface 712 of the pedal 700. Wedge 760 includes a relatively thin portion 764 which is disposed adjacent the toe end of the pedal 700, and a relatively thicker portion 766 which is disposed closer to the heel portion 708 of pedal 700. Wedge 760 provides an inclined surface on which roller 763 of the variable tension exerting means 702 can roll. Roller 763 is generally similar to roller 232 shown in FIG. 4.

Biasing means 758 is best shown in FIGS. 12 and 13, and is provided for normally biasing the tooth 724 into engagement with the teeth of position fixing means 726. Biasing means 758 includes a bolt 772, the end portion of which engages a threaded aperture of a nut 776. Nut 776 is fixed to the underside surface 761 of heel portion 708. A nut 778 is fixed to the underside surface 779 of toe portion 710, and includes an aperture for slidably receiving the intermediate portion of bolt 772. The aperture of nut 778 is large enough to permit unrestricted movement of bolt 772.

A spring 782 is captured between nut 778 and the head 784 of bolt 772, and is fixed to one of the head 784 and nut 778. The spring 782 exerts a restoring force on the portion 710 through nut 778. This force urges toe portion 710 to a position in which the toe tooth 724 engages the position fixing means 726. For example, if the toe portion 710 of the pedal 700 is moved in a direction indicated generally by arrow X, the spring 782 will be compressed, causing it to want to restore tooth 724 into engagement with position fixing means 726. The toe portion 710 cannot be moved in a direction opposite to that shown by arrow X, because of interference between nut 778 and heel portion 708.

What is claimed is:

1. A percussion instrument comprising a body member, a percussion head carried by the body member, a variable tension-exerting means for exerting variable tension on the head to vary the pitch of sound produced when the head is struck, the variable tension-exerting means including a crank arm having a follower means, means for operatively coupling the variable tension-exerting means to the percussion head, an actuating means for actuating the variable tension-exerting means, the actuating means comprising a user-actuable, pivotable member pivotable through an arc, the user actuable pivotable member including a guide means followed by the follower means through the arc of the user-actuable pivotable member to vary the tension on the head, the user actuable pivotable member comprising a pedal having a user-engageable surface and the guide means including a surface followed by the follower means, the surface being inclined relative to the user engageable surface, the engagement of the follower means and inclined surface operatively coupling the variable tension-exerting means to the actuating means.

2. A percussion instrument comprising a body member, a percussion head carried by the body member, a variable tension-exerting means for exerting variable tension on the head to vary the pitch of sound produced when the head is struck, the variable tension-exerting means including an arm and a follower means, means for operatively coupling the variable tension-exerting means to the percussion head, an actuating means for actuating the variable tension-exerting means, the actuating means comprising a user-actuable movable member having a generally planar user-engageable surface including a first portion, a second portion, a swivel means for swivelably connecting the second portion to the first portion to permit the second portion to swivel about an axis generally perpendicular to the planar user-engageable surface, the user actuable movable member including a guide means haing a surface followed by the follower means, the surface being inclined relative to the user engageable surface, a positioning means for mounting stationarily relative to the body member, an engaging means mounted to the second portion of the user-actuable movable member for selectively fixing the position of the user-actuable movable member, and a biasing means for biasing the engaging means into engagement with the positioning means the engagement of the inclined surface and the follower means operatively coupling the actuating means to the variable tension-exerting means.

3. A percussion instrument comprising a frame, a body member supported above the frame, a percussion head carried by the body member, a variable tension exerting means for exerting variable tension on the percussion head to vary the pitch of sound produced when the head is struck, a foot-actuable pedal operatively coupled to the variable tension exerting means for actuating the variable tension exerting means and an adjustable pedal platform for mounting the pedal to the frame and for permitting the location of the pedal relative to the frame to be changed selectively, the adjustable platform comprising a generally vertical member fixed relative to the frame, a generally horizontal member supported by the vertical member and movable along the vertical member, a pivot member pivotally coupled to the horizontal member, and pedal attachment means for attaching the pedal to the pivot member to permit the pedal to pivot relative to the horizontal member.

4. The invention of claim 3 wherein the platform is movable to permit the user to adjust the vertical location of the pedal and the horizontal location of the pedal.

5. The invention of claim 3 further comprising a platform location fixing means operatively coupled between the vertical member and horizontal member to fix the location of the horizontal member selectively relative to the vertical member, and wherein the horizontal member comrises a telescoping horizontal member for permitting the user to vary the horizontal location of the pedal.

6. The invention of claim 5 further comprising roller means rotatably mounted to the horizontal member and rollable along a surface of the vertical member to facilitate movement of the horizontal member along the vertical member, wherein the vertical member includes a vertical array of teeth and the platform location fixing means includes an array of teeth selectively engageable with the teeth of the vertical member for selectively coupling the pedal location fixing means to the vertical member.

* * * * *